US006938568B2

(12) United States Patent
Nakajima et al.

(10) Patent No.: US 6,938,568 B2
(45) Date of Patent: Sep. 6, 2005

(54) INNER LID ATTACHING STRUCTURE FOR A PERSONAL WATERCRAFT

(75) Inventors: Jun Nakajima, Saitama (JP); Tadaaki Nagata, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/660,111

(22) Filed: Sep. 11, 2003

(65) Prior Publication Data

US 2004/0083937 A1 May 6, 2004

(30) Foreign Application Priority Data

Sep. 11, 2002 (JP) ..... 2002-266085

(51) Int. Cl.[7] ..... B63B 35/73
(52) U.S. Cl. ..... 114/55.53
(58) Field of Search ..... 114/361, 363, 114/55.51, 55.53

(56) References Cited

U.S. PATENT DOCUMENTS 6,192,823 B1 * 2/2001 Tsumiyama et al. ..... 114/363
6,234,546 B1 * 5/2001 Asakura et al. ..... 292/165
2001/0000052 A1 * 3/2001 Yamada et al. ..... 114/55.53

* cited by examiner

*Primary Examiner*—Stephen Avila
(74) *Attorney, Agent, or Firm*—Carrier, Blackman & Associates, P.C.; William D. Blackman; Joseph P. Carrier

(57) ABSTRACT

A personal watercraft includes an inner lid attached in covering relation over a rear portion opening provided in a deck of the personal watercraft, in which a rear edge of the rear portion opening is pressed by a locking member disposed in a locking position thereof to assure the air-tightness of the inner lid, and a rear cover 48 is provided in covering relation over the inner lid. A projection is provided integrally on the locking member which allows attachment of the rear cover when the locking member is in the locked position, but blocks attachment of the rear cover by being sandwiched between the deck and the rear cover, when the locking member is at an unlocked position thereof. A torsion spring (biasing member) which biases the locking member toward the unlocked position is provided between the locking member and the deck. The attaching structure prevents the inner lid from being not attached inadvertently.

15 Claims, 12 Drawing Sheets

INNER LID ATTACHING STRUCTURE FOR A PERSONAL WATERCRAFT

BACKGROUND OF THE INVENTION

1. Field of the Invention

This invention relates to an inner lid attaching structure for a personal watercraft. More particularly, the present invention relates to a covered inner lid attaching structure for a personal watercraft that air-tightly closes an opening in a deck of the watercraft and prevents inadvertent failure to install the covered inner lid.

2. Description of the Relevant Art

Although a search for related art document information was conducted in a search field based on the International Patent Classification, no relevant document was located. It seems that this is because the present invention is directed to a technique of a very special field.

Therefore, the inventors of the present invention describe a related art apparatus with reference to FIG. 13 of the drawings in place of related art document information, which is a schematic view of an inner lid attaching structure for a personal watercraft. The depicted inner lid attaching structure 220 for a personal watercraft is a structure wherein an opening 222 for maintenance is provided in a deck 221 and an inner lid 223 closes the opening 222, while a cover 224 is fitted from above the inner lid 223 to cover the inner lid 223.

In the inner lid attaching structure 220 for a personal watercraft described above, if it is intended to access the opening 222 for maintenance, then the opening 222 can be opened by removing the cover 224 from the deck 221 and then removing the inner lid 223. However, when it is intended to close the opening 222, the cover 224 can be fitted without attaching the inner lid 223. Accordingly, there is the possibility that the cover 224 may be fitted without attaching the inner lid 223 inadvertently after maintenance. Particularly, for a location which requires a high degree of sealing, a structure is preferable which does not allow attachment of the cover 224 unless the inner lid 223 is attached.

In other words, a technique which can prevent the inner lid 223 from being not attached inadvertently is required.

SUMMARY OF THE INVENTION

Therefore, the object of the present invention resides in provision of an inner lid attaching structure for a personal watercraft which can prevent an inner lid from being not attached inadvertently.

In order to achieve the object described above, according to one aspect of the present invention, there is provided an inner lid attaching structure for a personal watercraft having an inner lid removably attachable in covering relation to an opening provided in a deck of the personal watercraft and a cover removably attachable in covering relation to the inner lid, the attaching structure comprising: a locking member which presses an edge of the inner lid placed on an edge of the opening against the edge of the opening when the locking member is in a locked position to assure air-tightness between the inner lid and the edge of the opening;

a projection provided integrally with the locking member which allows attachment of the cover when the locking member is at the locked position, but blocks attachment of the cover by being sandwiched between the deck and the cover when the locking member is at an unlocked position; and a biasing member which biases the locking member toward the unlocked position, and is provided between the locking member and the deck.

With such attaching structure according to the invention, the inner lid is attached in covering relation to the opening and the edge of the inner lid placed on the edge of the opening is pressed by the locking member in its locked position to assure the air-tightness between the inner lid and the edge of the opening, and the inner lid is covered with the cover. When the inner lid is removed from the deck for maintenance or other purposes, the biasing member automatically returns the locking member to the unlocked position. If it is attempted to attach the cover when the locking member is at the unlocked position, then the projection of the locking member is sandwiched between the deck and the cover thereby blocking attachment of the cover. Consequently, if the inner lid is not attached, then the cover cannot be fitted. As a result, the inner lid can be prevented from being not attached inadvertently.

For a more complete understanding of the present invention, the reader is referred to the following detailed description section, which should be read in conjunction with the accompanying drawings. Throughout the following detailed description and in the drawings, like numbers refer to like parts.

BRIEF DESCRIPTION OF THE DRAWINGS

FIG. 4(*b*) is a view similar to FIG. 4(*a*), but with a bridge member secured in place over a boundary between the openings.

FIG. 5(*b*) is a view similar to FIG. 4(*b*), but with an inner lid secured in place over the rear portion opening and the rear cover.

FIG. 7(*b*) is a schematic side elevational view similar to FIG. 7(*a*), but which shows the personal watercraft which adopts the deck structure according to the present invention.

DETAILED DESCRIPTION OF THE INVENTION

Figure 1:
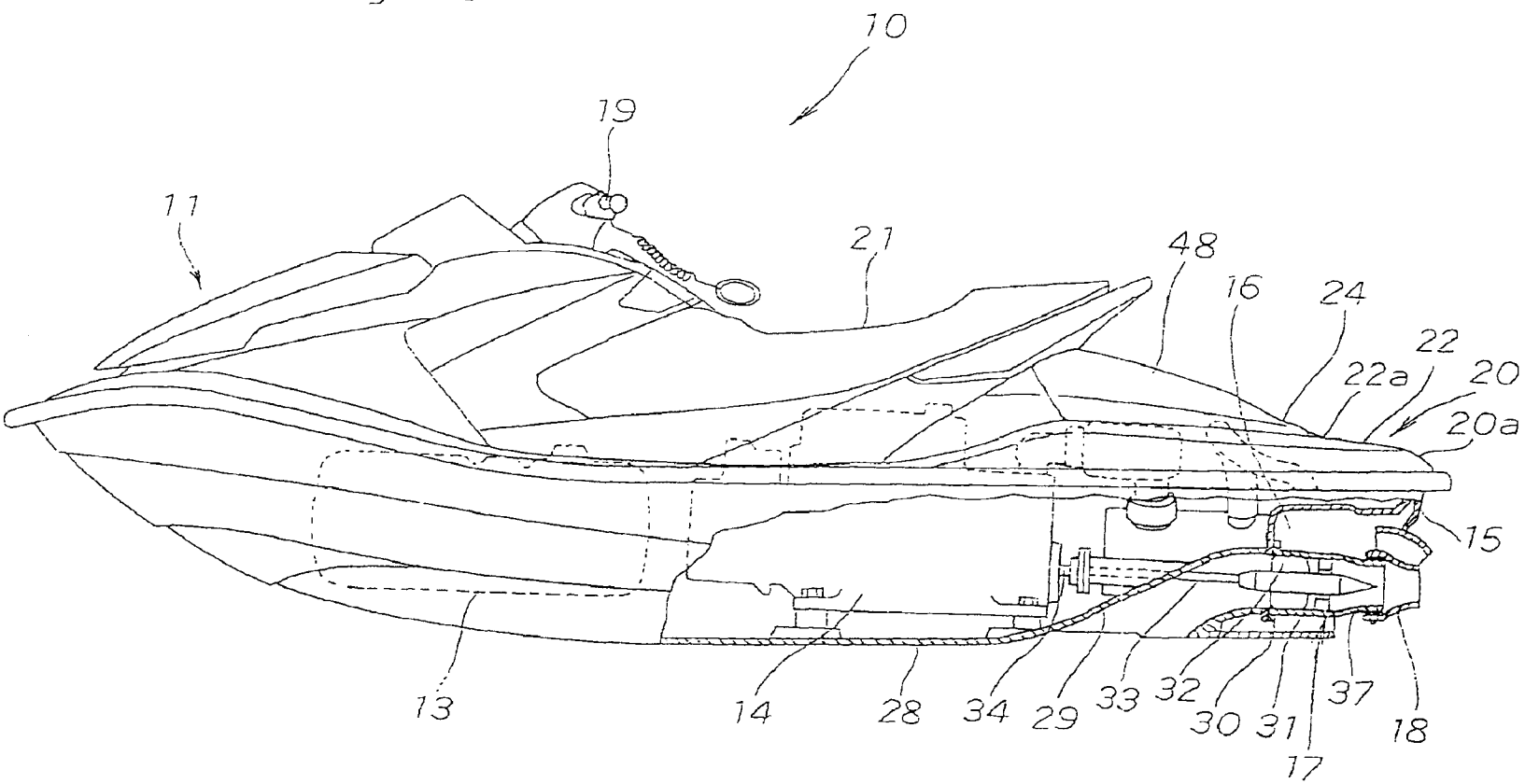
FIG. 1 is a side elevation view of a personal watercraft which adopts a deck structure according to the present invention, with an engine and various other equipment shown via partial cutaway and broken lines.

In the following, an embodiment of the present invention is described with reference to the accompanying drawings. Here, the terms "front", "rear", "left" and "right" represent directions as viewed by a driver of the watercraft. It is to be noted that the drawings should also be viewed in the directions indicated by reference characters in the drawings.

FIG. 1 is a side elevation view of a personal watercraft which adopts an aspect of the deck structure according to the present invention.

The personal watercraft 10 includes a fuel tank 13 provided at a front portion of a craft body 11. An engine 14 is provided rearwardly of the fuel tank 13. A jet propeller chamber 16 is provided at a stern 15 rearwardly of the engine 14. A water jet propeller 17 is provided in the jet propeller chamber 16. A steering nozzle 18 is provided rearwardly of the water jet propeller 17. A steering handle member 19 for operating the steering nozzle 18 is provided above the fuel tank 13. A seat 21 is provided at a central portion of a deck 20, which forms an upper face of the craft body 11, rearwardly of the steering handle member 19 such that it extends forwardly and rearwardly. A rear platform (platform) 22 is provided rearwardly of the seat 21 such that it extends substantially horizontally forwardly from a rear end portion 20*a* of the deck 20. An inclined face portion 24 having an upward slope is provided such that it extends toward the seat 21 from a front end center (front end) 22*a* of the rear platform 22. A cover (rear cover) 48 is provided between the seat 21 and the rear platform 22.

The water jet propeller 17 has an inlet port 29 formed in a craft bottom 28 of the craft body 11 thereof. The inlet port 29 extends to the jet propeller chamber 16. A cylindrical stator 31 is provided on a wall portion (stator plate) 30 of the jet propeller chamber 16. An impeller 32 is disposed in the stator 31. A drive shaft 34 is connected rearwardly to a shaft 33 of the impeller 32 and frontally connected to the engine 14 for transmitting driving power of the engine 14.

With the personal watercraft 10, the impeller 32 can be rotated through the shaft 33 by rotating the drive shaft 34 by means of the engine 14. When the impeller 32 rotates, water can be taken in by the inlet port 29 and introduced into the stator 31. The thus introduced water can be propelled to the steering nozzle 18 through a jet nozzle 37 at a rear end of the stator 31 and then expelled rearwardly as a water jet from the rear end of the steering nozzle 18. The expelled water can be utilized to propel the personal watercraft 10.

Figure 2:
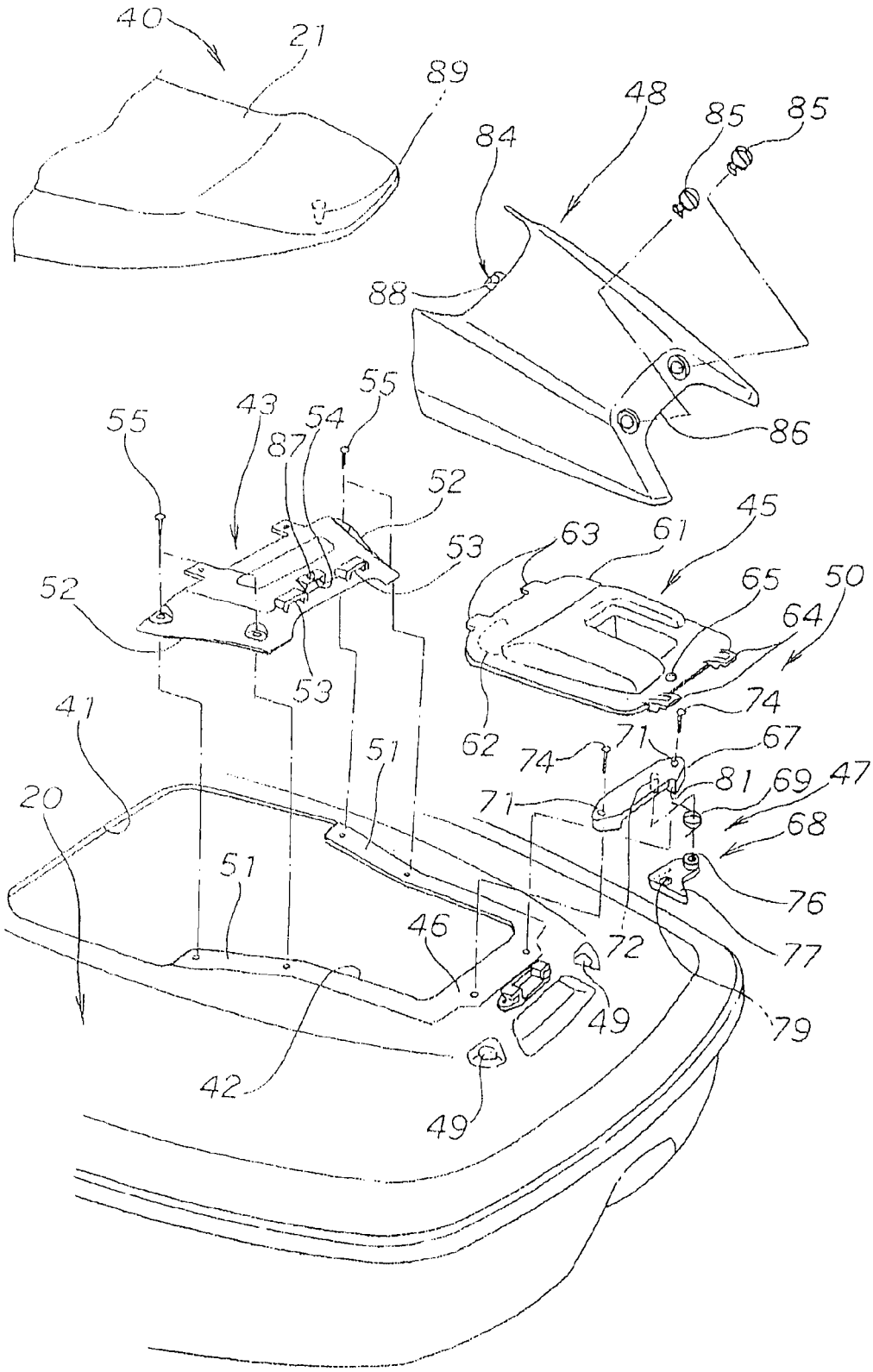
FIG. 2 is an exploded perspective view of a rear portion of the personal watercraft which adopts the deck structure according to the present invention.

FIG. 2 is an exploded perspective view of a rear portion of the personal watercraft which adopts the deck structure according to the present invention. The rear portion of the personal watercraft 10 is formed from a seat underlying opening 41 provided in the deck 20, a rear portion opening 42 as an opening provided in the deck 20 continuously to the seat underlying opening 41, a bridge plate 43 extending along the boundary between the seat underlying opening 41 and the rear portion opening 42, the seat 21 which covers or closes up the seat underlying opening 41, an inner lid 45 for covering or closing up the rear portion opening 42, a locking mechanism 47 attached to a rear edge 46 as an edge of the rear portion opening 42 for locking the inner lid 45, the rear cover 48 serving as a cover for covering the inner lid 45, and a pair of engaging portions 49, 49 for engaging the rear cover 48 on the deck 20 side.

In particular, it can be considered that a deck structure 40 of the personal watercraft is configured such that the seat underlying opening 41 is formed in the deck 20 of the personal watercraft 10 and the rear portion opening 42 is formed continuously to the rear of the seat underlying opening 41 while the bridge plate 43 is removably attached to the boundary between the seat underlying opening 41 and the rear portion opening 42 such that the rear portion of the seat 21 is supported by the bridge plate 43 and the rear portion opening 42 is covered or closed up with the rear cover 48.

For example, the engine and other equipment are arranged inside of the deck structure 40 of the personal watercraft. When maintenance of the engine and other equipment may be performed, it is in most cases performed through the seat underlying opening with the seat removed. Accordingly, it is preferable that the seat underlying opening is large.

Therefore, according to an important aspect of the present invention the rear portion opening 42 is formed continuously to the rear of the seat underlying opening 41 and the bridge plate 43 is removably mounted on the boundary between the seat underlying opening 41 and the rear portion opening 42 (or at the rear portion opening 42) such that the rear portion of the seat 21 is supported by the bridge plate 43, and the rear portion opening 42 is, again, covered or enclosed by the rear cover 48.

When maintenance of the engine 14 and other equipment is to be performed, the bridge plate 43 may be removed. As a result, the seat underlying opening 41 and the rear portion opening 42 are connected to each other, and therefore, a large opening can be obtained. Consequently, improvement of the operability in maintenance can be anticipated.

Subsequently, details of the components mentioned above are described.

The bridge plate 43 has a pair of flange portions 52, 52 to be placed on side edges 51, 51 as edges of the rear portion opening 42 for attaching the bridge plate 43 to the deck 20, a pair of left and right fitting portions 53, 53 into which the inner lid 45 is to be fitted, and a central fitting portion 54 into which the rear cover 48 is to be fitted. It is to be noted that reference characters 55, . . . ( . . . indicate a plural number, and similarly apply to the following description) denote fastening screws for fastening the bridge plate 43 to the side edges 51, 51 of the rear portion opening 42.

The inner lid 45 is a member in the form of a plate and has a packing or gasket 62 attached to an edge 61 of the inner lid 45 for sealing the rear portion opening 42, a pair of front projections 63, 63 for being fitted into the left and right fitting portions 53, 53 of the bridge plate 43, a pair of rear projections 64, 64 for being placed on the rear edge 46 of the rear portion opening 42, and a fitting projection 65 for engaging with the locking mechanism 47.

The locking mechanism 47 includes a lock base 67 attached to the deck 20, a locking member 68 attached for swinging movement within a predetermined range to the lock base 67, and a torsion spring 69 serving as a biasing member extending between the locking member 68 and the lock base 67.

The lock base 67 has formed therein a pair of attaching holes 71, 71 for attaching the lock base 67 to the deck 20, a supporting portion 72 for supporting the locking member 68 for swinging movement, a spring anchoring portion (not shown) for anchoring one end of the torsion spring 69, and a stopper portion 81 for restricting the range of the swinging movement of the locking member 68 to a predetermined angle. It is noted that reference numerals 74, 74 denote fastening screws for attaching the lock base 67 to the deck 20.

The locking member 68 has formed therein or thereon a supporting hole 76 in which the supporting portion 72 of the lock base 67 is fitted for swinging movement, a projection 77 which is formed at a corner of the locking member 68 farthest from the supporting hole 76, a spring anchoring portion (not shown) for anchoring the other end of the torsion spring 69, and a fitting recess 79 into which the engaging projection 65 of the inner lid 45 is to be engaged.

The torsion spring 69 is a member which biases the locking member 68 toward an unlocked position thereof, where the position of the locking member 68 with respect to the deck 20 when the torsion spring 69 holds down the inner lid 45 is called "locked position" while the position of the locking member 68 with respect to the deck 20 when the inner lid 45 is removed is called the "unlocked position".

In particular, according to the locking mechanism 47, the fitting recess 79 of the locking member 68 is engaged with the engaging projection 65 on the inner lid 45 side so that the locking member 68 keeps a locked posture at the locked position. However, when the fitting recess 79 is removed from the engaging projection 65, the inner lid 45 can be removed. Thereupon, the locking member 68 is automatically swung to the predetermined angle, and when the inner lid 45 is not present, the locking member 68 is normally kept in an unlocking posture at the unlocked position.

The rear cover 48 is a substantially tunnel-shaped cover and has a central projection 84 for being fitted into the central fitting portion 54 of the bridge plate 43 and a pair of engaging knobs 85, 85 for engaging with the engaging portions 49, 49 of the deck 20. Reference numeral 86 denotes a rear edge.

It is to be noted that reference numeral 87 denotes a through-hole located in the central fitting portion 54, 88 a through-hole located in the central projection 84, and 89 a downward projection formed on a lower face of the seat 21. When the seat 21 is to be attached, the downward projection 89 is inserted into the through-hole 88 to secure the rear cover 48.

Figure 3:
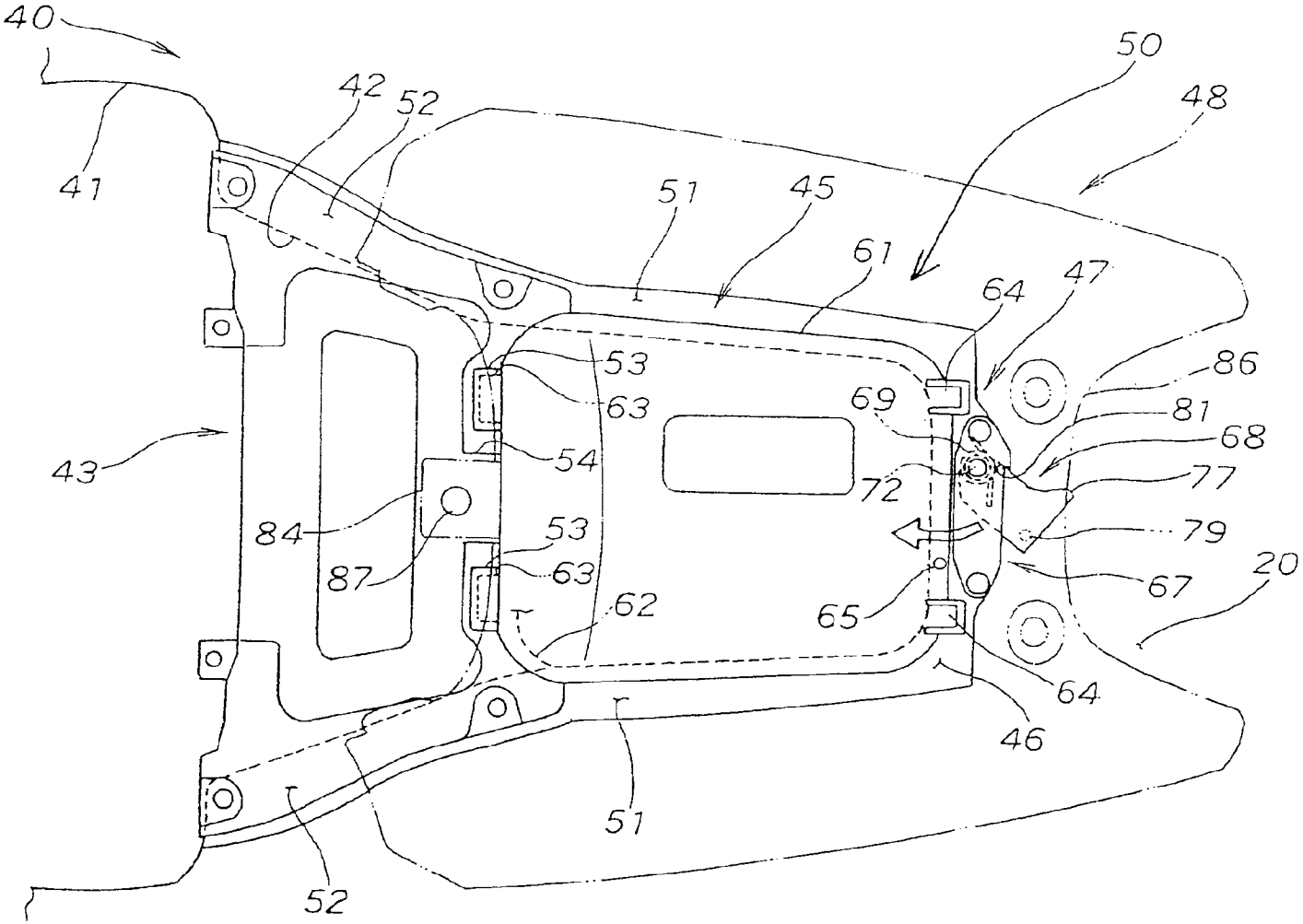
FIG. 3 is a top plan view of the rear portion of the personal watercraft which adopts the deck structure according to the present invention.

FIG. 3 is a plan view of the rear portion of the personal watercraft which adopts the deck structure according to the present invention. As shown in FIG. 3, the bridge plate 43 is attached to the boundary between the seat underlying opening 41 and the rear portion opening 42 (or to the rear portion opening 42). The front projections 63, 63 of the inner lid 45 are inserted in the left and right fitting portions 53, 53 of the bridge plate 43. The inner lid 45 is locked with the locking member 68 of the locking mechanism 47. The central projection 84 of the rear cover 48 is inserted in the central fitting portion 54 of the bridge plate 43. The rear cover 48 is engaged by the engaging portions 49, 49 on the deck 20 side.

As hereinafter described, it is shown that, at the unlocked position of the locking member 68 indicated by a solid line, the projection 77 of the locking member 68 is held between the deck 20 and the rear cover 48, and the rear cover 48 cannot be attached. Further, the locked position is a position at which the fitting recess 79 of the locking member 68 is engaged with the engaging projection 65 of the inner lid 45.

It can be considered that an inner lid attaching structure 50 of the personal watercraft is configured such that, in the personal watercraft 10 (refer to FIG. 1) wherein the inner lid 45 is attached to the rear portion opening (opening) 42 provided in the deck 20 of the personal watercraft 10 (refer to FIG. 1) with the gasket 62 interposed therebetween and the edge 61 of the inner lid 45 placed on the side edges 51, 51 and the rear edge 46 of the rear portion opening 42 is pressed against the side edges 51, 51 and the rear edge 46 by the locking member 68 rotated as indicated by a void arrow mark to the locked side to assure the air-tightness of the inner lid 45 while the inner lid 45 is covered with the rear cover (cover) 48. Also, the projection 77 which allows attachment of the rear cover 48 when the locking member 68 is at the locked position but is sandwiched, when the locking member 68 is at the unlocked position indicated by a solid line, between the deck 20 and the rear cover 48 to block attachment of the rear cover 48 is provided integrally on the locking member 68, and the torsion spring (biasing member) 69 for biasing the locking member 68 toward the unlocked position is provided between the locking member 68 and the deck 20.

For example, in the structure wherein the inner lid is attached to the opening provided in the deck and is covered from above with the rear cover, it is preferable to configure the structure such that the rear cover cannot be attached if the inner lid is not present in order to prevent a situation in which the inner lid is not attached inadvertently.

The inner lid 45 is attached to the rear portion opening (opening) 42 with the gasket or packing 62 interposed therebetween. Further, the edge 61 of the inner lid 45 placed on the side edges 51, 51 and the rear edge 46 of the rear portion opening 42 is pressed by the locking member 68 rocked to the locking side to assure the air-tightness of the inner lid 45, and the inner lid 45 is covered with the rear cover 48.

When the inner lid 45 is removed from the deck 20, the torsion spring (biasing member) 69 automatically returns the locking member 68 to the unlocked position. If the rear cover 48 is attempted to be attached when the locking member 68 is at the unlocked position, then the projection 77 of the locking member 68 is sandwiched between the deck 20 and the rear cover 48 thereby to block attachment of the rear cover 48. Consequently, if the inner lid 45 is not attached, then the rear cover 48 cannot be fitted. As a result, the inner lid 45 is prevented from not being attached inadvertently.

Action of the inner lid attaching structure 50 of the personal watercraft described above is described below.

Figure 4:
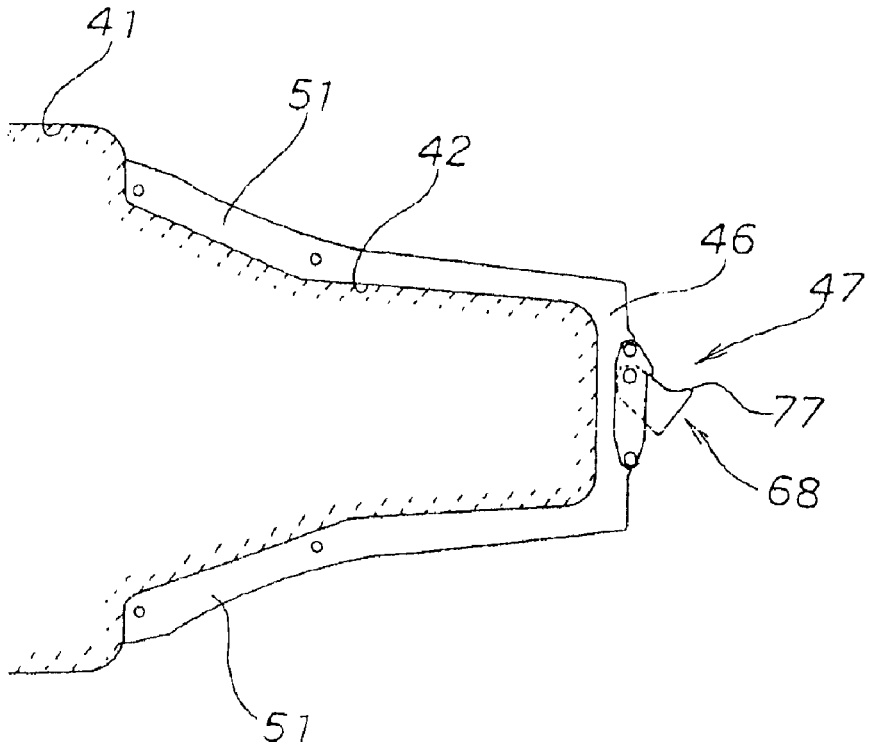
FIG. 4(*a*) is a schematic top plan view of part of the rear portion of the personal watercraft in which the continuously extending seat underlying and rear portion openings are fully exposed.
Figure 4:
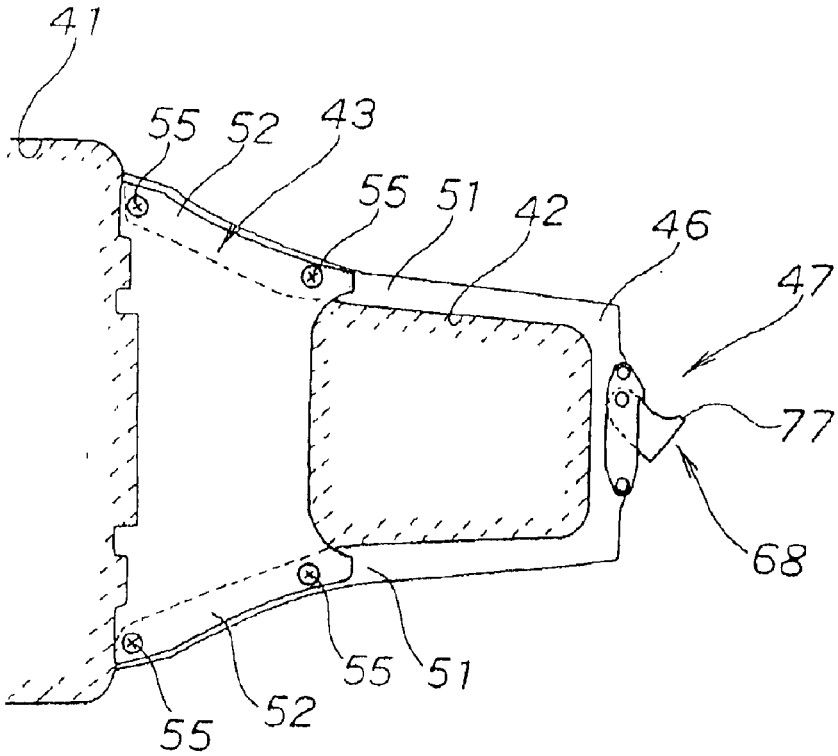

FIGS. 4(*a*) and (*b*) are schematic views of first action (part 1) of the personal watercraft which adopts the deck structure according to the present invention.

Referring to FIG. 4(*a*), the deck 20 is depicted before the bridge plate 43, inner lid 45 and cover 48 shown in FIG. 2 are attached. In particular, the seat underlying opening 41 and the rear portion opening 42 are openings which are in an open state and are contiguous to each other, and the locking member 68 is in a state wherein it maintains an unlocking state at the unlocked position.

Referring to FIG. 4(*b*), the flange portions 52, 52 of the bridge plate 43 are placed onto the side edges 51, 51 of the rear portion opening 42 and secured by fastening screws 55 or other appropriate fastening means.

Figure 5:
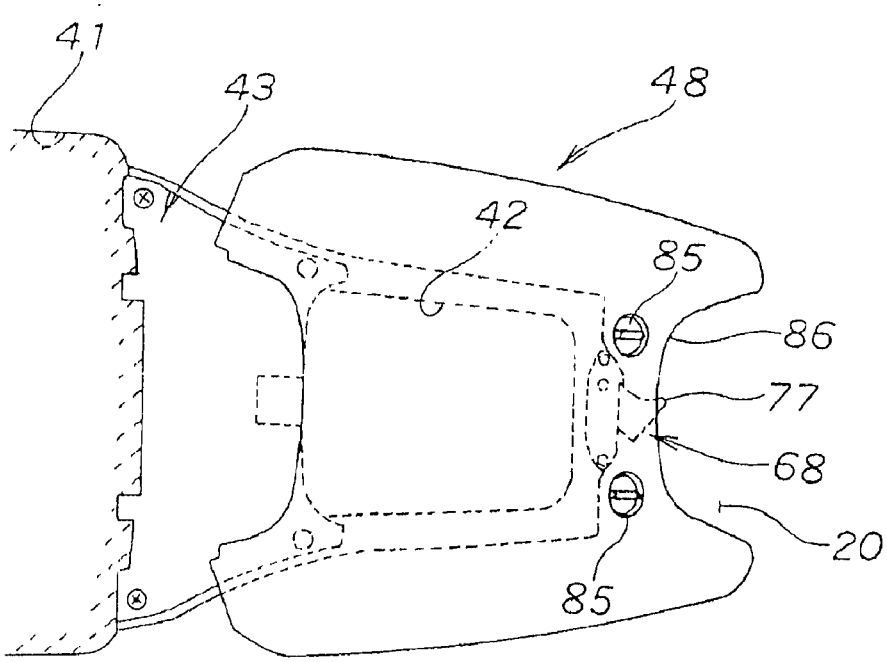
FIG. 5(*a*) is a schematic top plan view similar to FIG. 4(*b*), but with a rear cover also disposed over the rear cover opening.
Figure 5:
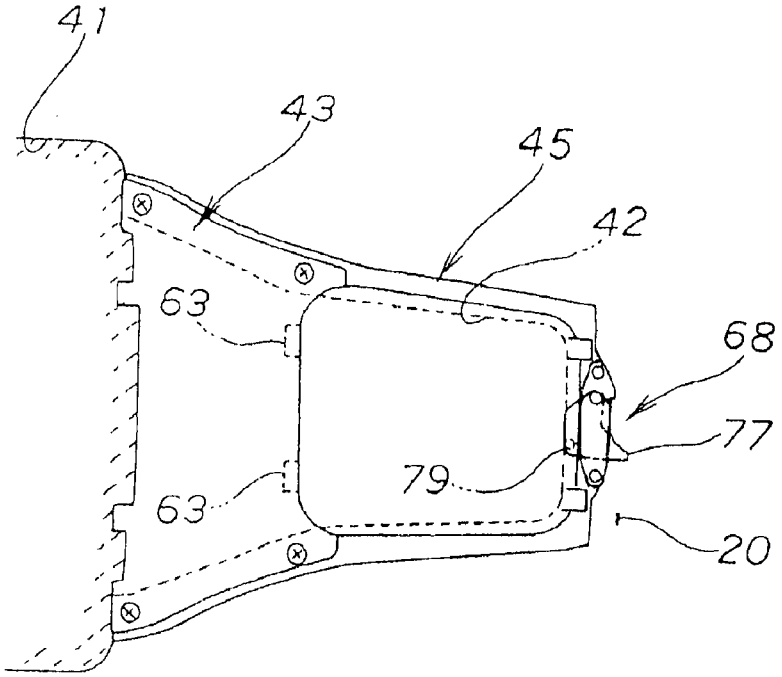

FIGS. 5(*a*) and (*b*) are schematic views of the first action (part 2) of the personal watercraft which adopts the deck structure according to the present invention.

Referring to FIG. 5(*a*), action is described in the case where it is attempted to attach the rear cover 48 while the inner lid 45 shown in FIG. 2 is not attached, inadvertently. Since the inner lid 45 is not attached as yet, the locking member 68 keeps the unlocked posture at the unlocked position, and if the rear cover 48 is adjusted to a predetermined position of the deck 20, then the rear edge 86 of the rear cover 48 and the rear edge 46 of the deck 20 sandwich the projection 77 of the locking member 68. Accordingly, the engaging knobs 85, 85 of the rear cover 48 do not fit with the engaging portions 49, 49 (FIG. 2) of the deck 20, and the rear cover 48 cannot be attached.

Consequently, if the inner lid 45 (refer to FIG. 2) is not attached, then the rear cover 48 cannot be fitted. As a result, the condition of inadvertently omitting the inner lid 45 while attaching rear cover 48 is prevented.

In FIG. 5(*b*), the front projections 63, 63 of the inner lid 45 are inserted into the left and right fitting portions 53, 53 (refer to FIG. 2) of the bridge plate 43, and the fitting recess 79 of the locking member 68 is fitted with the engaging projection 65 (refer to FIG. 2) of the inner lid 45. As a result, the inner lid 45 is pressed by the locking member 68, and the locking member 68 is kept in the locking state at the locked position shown in FIG. 5(*b*).

Figure 6:
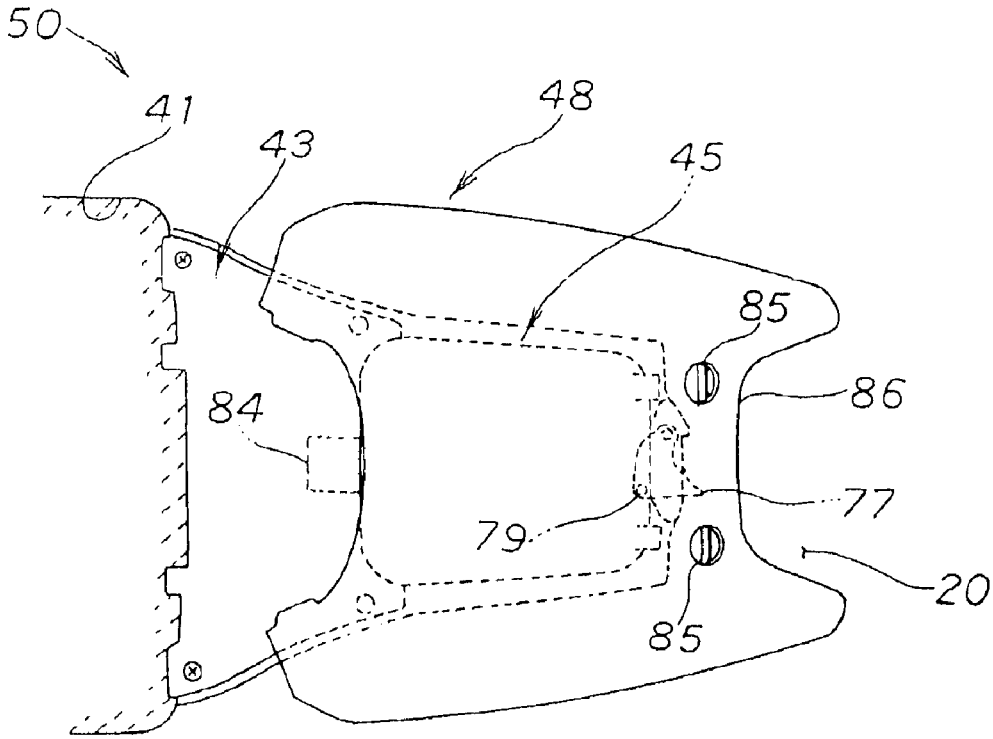
FIG. 6 is a schematic top plan view similar to FIG. 5(*b*), but with both the inner lid and the rear cover properly secured in place over the rear portion opening.

FIG. 6 is a schematic view of the first action (part 3) of the personal watercraft which adopts the deck structure according to the present invention. The central projection 84 of the rear cover 48 is inserted into the central fitting portion 54 (refer to FIG. 2) of the bridge plate 43, and the engaging knobs 85, 85 of the rear cover 48 are engaged by the engaging portions 49, 49 (refer to FIG. 2) of the deck 20, thereby completing the attachment of the inner lid 45 and the rear cover 48.

In particular, the inner lid attaching structure 50 of the personal watercraft is a structure wherein, when the inner lid 45 is removed from the deck 20, the torsion spring 69 (refer to FIG. 2) automatically returns the locking member 68 to the unlocking position shown in FIG. 5(*a*), and if it is tried to attach the rear cover 48 when the locking member 68 is at the unlocking position, then the projection 77 of the locking member 68 is sandwiched between the deck 20 and the rear cover 48 to block the attachment of the rear cover 48. Thus, the inner lid attaching structure 50 of the personal watercraft is a structure which can prevent a situation in which the inner lid 45 is inadvertently not attached.

Figure 7:
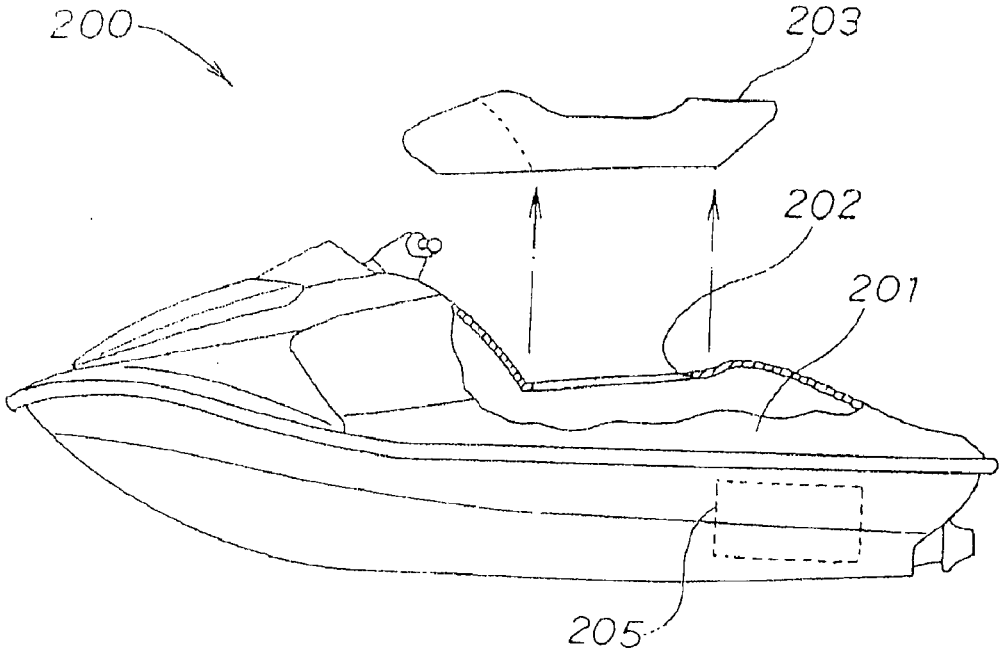
FIG. 7(*a*) is a schematic side elevational view, partly cutaway, showing a personal watercraft with a comparative deck structure wherein a seat is shown separated from the deck structure.
Figure 7:
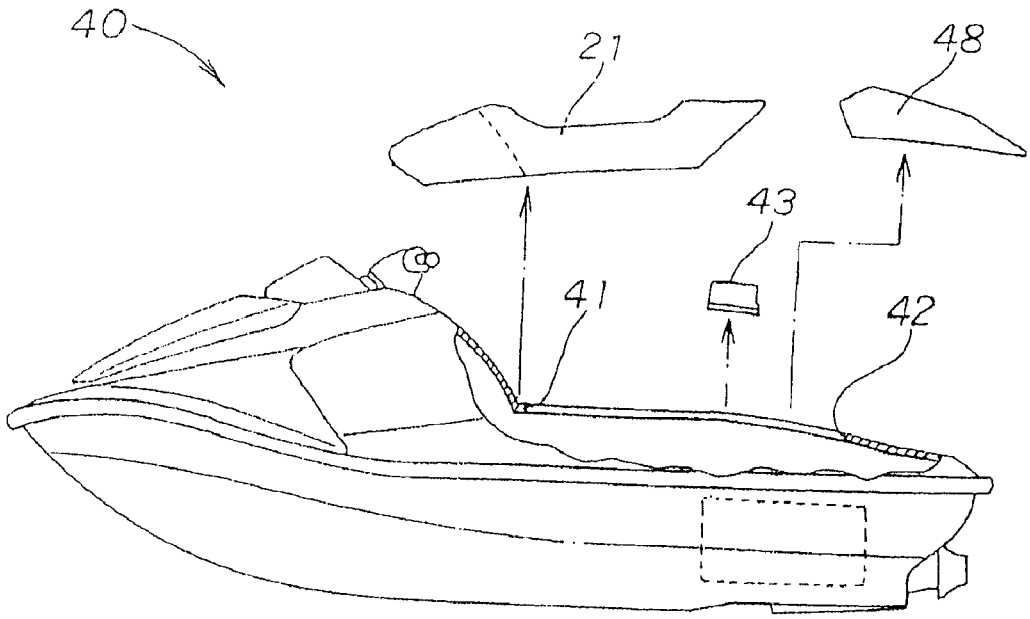

FIGS. 7(*a*) and (*b*) are schematic views of a second action of the personal watercraft which adopts the deck structure according to the present invention, in which FIG. 7(*a*) shows a deck structure 200 of a personal watercraft of a comparative example, while FIG. 7(*b*) shows the deck structure 40 of the personal watercraft of the embodiment.

Referring to FIG. 7(*a*), according to the deck structure 200 of the personal watercraft, a seat underlying opening 202 is provided in a deck 201 and closed up with a seat 203. When maintenance of an engine and other equipment inside of the deck 201 is performed, maintenance of equipment 205 which is positioned at a position displaced from the seat underlying opening 202 cannot be performed readily.

Referring to FIG. 7(*b*), according to the deck structure 40 of the personal watercraft, the rear portion opening 42 is provided continuously to the rear of the seat underlying opening 41, and the bridge plate 43 is removably attached to the boundary between the seat underlying opening 41 and the rear portion opening 42 (or to the rear portion opening 42) such that it supports the rear portion of the seat 21 while the rear portion opening 42 is closed up with the inner lid 45 and rear cover 48.

Accordingly, when maintenance of the engine 14 (refer to FIG. 1) and other equipment is to be performed, the bridge plate 43 is removed. Thereupon, the seat underlying opening 41 and the rear portion opening 42 join together, and consequently, a large opening can be obtained. Consequently, improvement of the operability in maintenance can be achieved.

Figure 8:
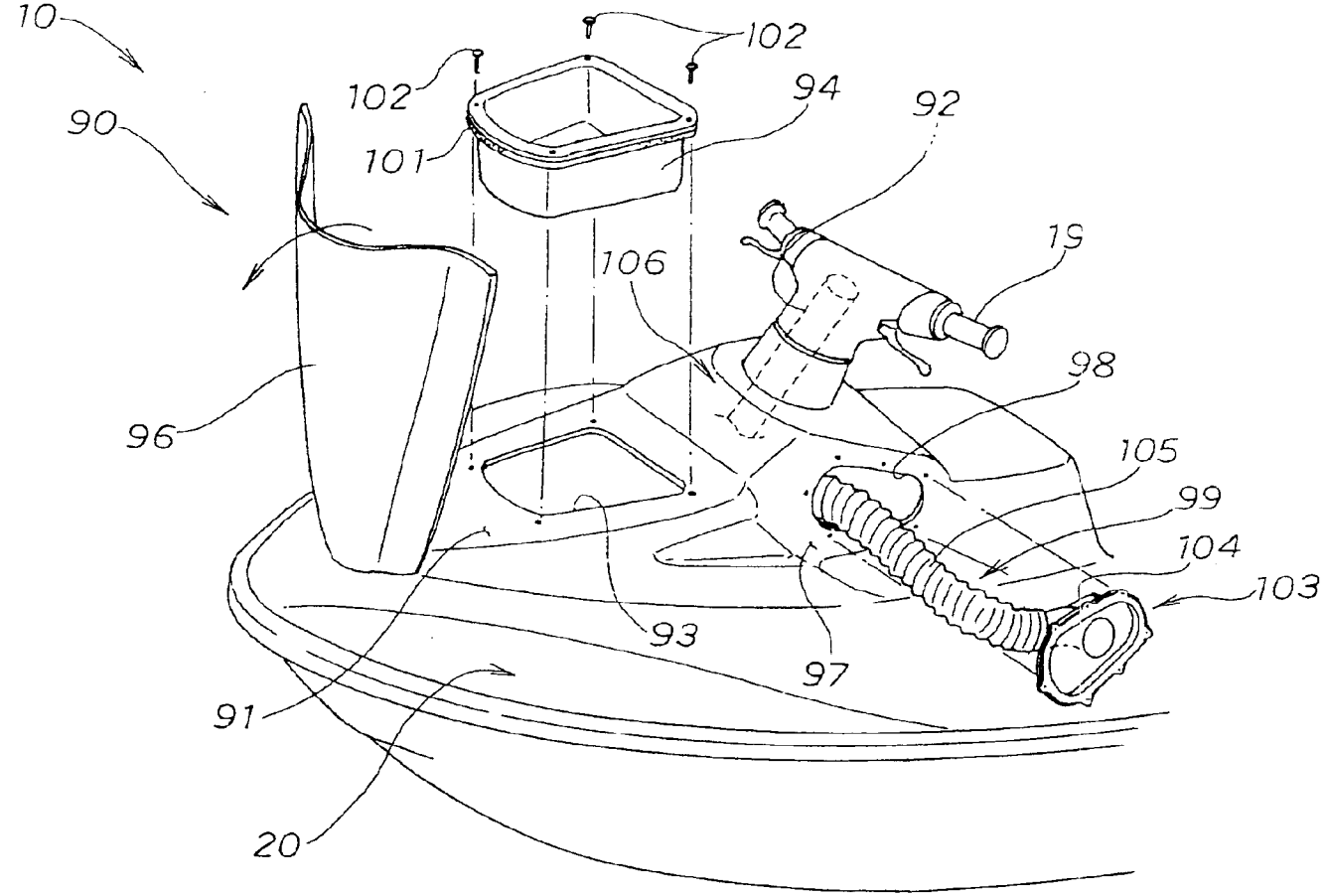
FIG. 8 is an exploded perspective view of a front portion of the personal watercraft which adopts the deck structure according to the present invention.

FIG. 8 is an exploded perspective view of the front portion of the personal watercraft which adopts the deck structure according to the present invention. The front portion of the personal watercraft 10 includes a main opening 93 serving as a maintenance opening provided in the proximity of a steering shaft 92 on a front portion upper face 91 of the deck 20, a box 94 removably attached to the main opening 93 so as to be used as a container, a front cover 96 serving as a main lid attached to the deck 20 for opening and closing movement by a hinge (not shown) for covering the top of the box 94, a sub opening 98 serving as a maintenance opening provided in the proximity of the steering shaft 92 in a left side wall 97 serving as a side wall of the deck 20, and a duct unit 99 which closes up the sub opening 98.

Reference numeral 101 denotes a gasket or packing interposed between the main opening 93 and the box 94, and reference numerals 102, . . . denote fastening screws or other appropriate fastening means for the box 94.

The duct unit 99 is a unit for exhausting air from the deck 20. The duct unit 99 includes a sub lid 103 for closing up the sub opening 98 and exhausting air therethrough, and an exhaust duct 105 serving as an intake/exhaust duct attached to the attaching portion 104 of the sub lid 103.

The main opening 93 plays a role of an opening for maintenance when the front cover 96 is opened and the box 94 is removed. The sub opening 98 plays a role of an opening for maintenance when the sub lid 103 is removed and the exhaust duct 105 attached integrally to the sub lid 103 is pulled off. In particular, it can be considered that a maintenance opening arrangement structure 90 for a personal watercraft is a structure that the main opening 93 and the sub opening 98 are provided around the steering shaft 92. For example, around the steering shaft 92, many rotatable members are present. Therefore, where the main opening 93 and the sub opening 98 are provided around the steering shaft 92, it is possible to hold one of the members with the left hand and perform a maintenance operation of the other member with the right hand.

Further, it can be considered that, according to the maintenance opening arrangement structure 90 of the personal watercraft, when the sub opening 98 is closed up with the sub lid 103, the sub lid 103 serves also as the attaching portion 104 of the exhaust duct 105.

It is preferable, for example, to use an opening for maintenance also for another application in order to achieve efficient utilization of parts. Therefore, when the sub opening 98 is closed up with the sub lid 103, the sub lid 103 serves also as the attaching portion 104 of the exhaust duct 105. Consequently, in a state of use, the sub lid 103 is utilized as an exhaust port. However, upon maintenance, the sub lid 103 is removed, whereupon the exhaust duct 105 is pulled off simultaneously. Consequently, a maintenance operation can readily be performed.

As a result, efficient utilization of parts can be anticipated. Further, the number of openings for exclusive use for maintenance can be reduced, and improvement of the design of the personal watercraft 10 can be anticipated.

Figure 9:
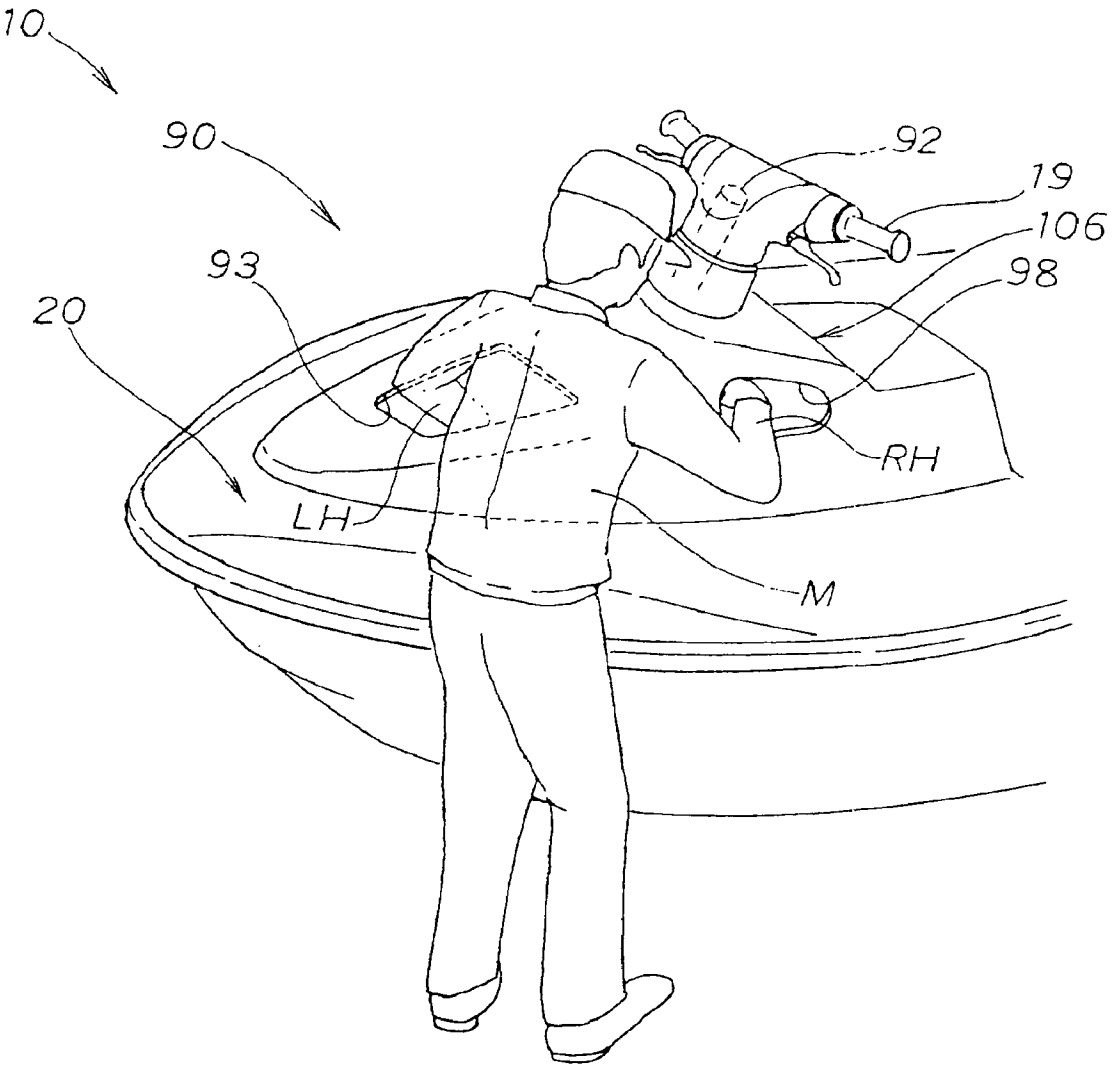
FIG. 9 is a perspective view showing an individual servicing a front portion of the personal watercraft which adopts the deck structure according to the present invention.

FIG. 9 is a schematic view of a third action of the personal watercraft which adopts the deck structure according to the present invention. It can be considered that the maintenance opening arrangement structure 90 of the personal watercraft is configured such that, in the personal watercraft 10 wherein the main opening 93 and the sub opening 98 for maintenance are provided in the deck 20 of the personal watercraft 10, the main opening 93 and the sub opening 98 are provided at positions at which a maintenance operation can be performed with one hand of an operator M extending in the main opening 93 and with the other hand of the operator M extending in the sub opening 98.

For example, it is preferable that certain maintenance operations be performed by making use of both the main opening 93 and the sub opening 98 at the same time in order to improve the operability of the maintenance operation. Therefore, the main opening 93 and the sub opening 98 are provided at positions at which the operator M can perform a maintenance operation with one hand thereof extending in the main opening 93 and with the other hand thereof extending in the sub opening 98. For example, the operator M can insert a left hand LH thereof into the main opening 93 and insert a right hand RH into the sub opening 98 to perform a maintenance operation using both hands, as depicted. As a result, improvement of the operability of the maintenance operation can be achieved.

In the following, an example of a maintenance operation around the steering shaft 92 through the sub opening (sub opening) 98 is described.

Figure 10:
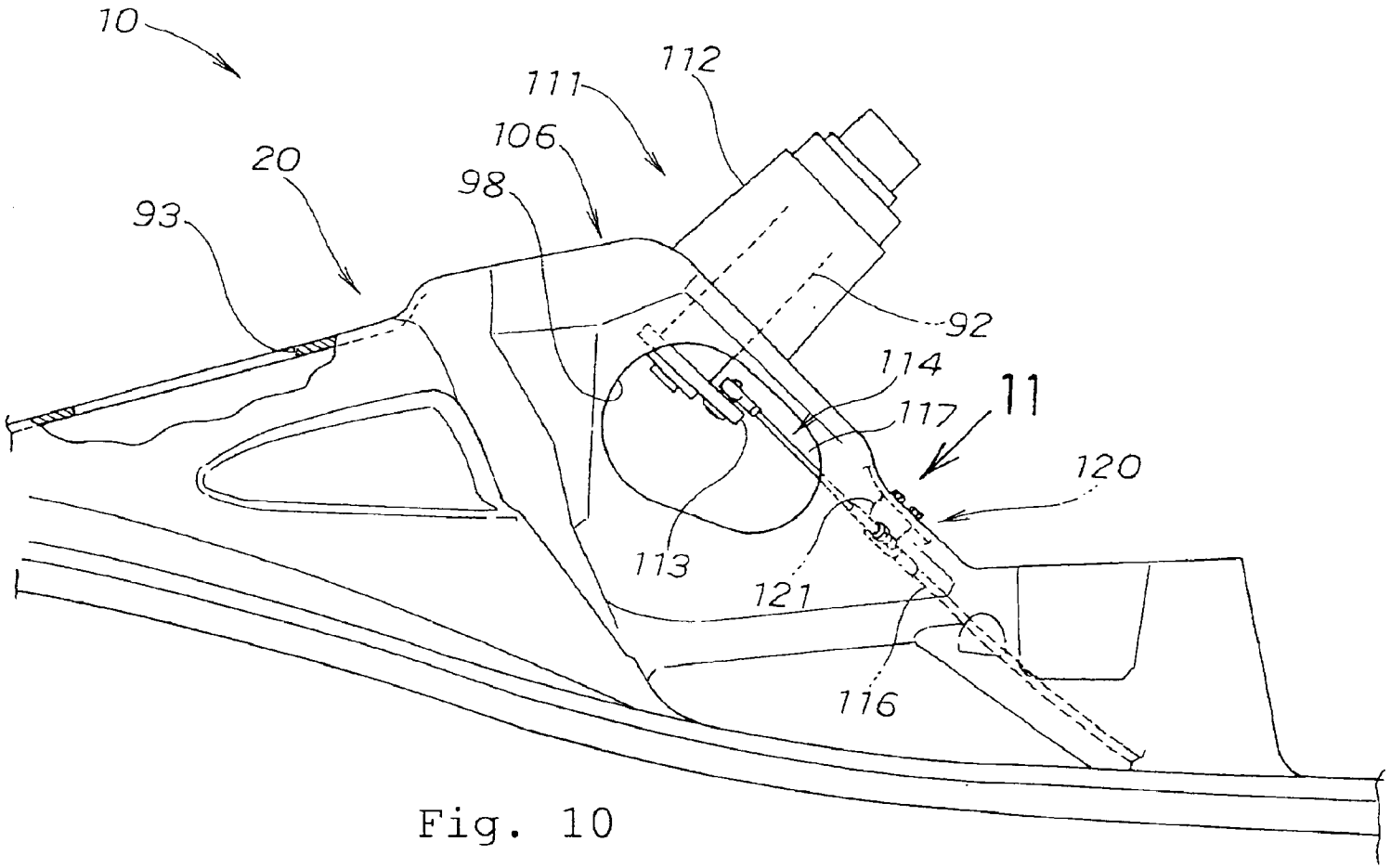
FIG. 10 is a side elevation view of an essential part of the personal watercraft which adopts the deck structure according to the present invention.

FIG. 10 is a side elevation view of an essential part of the personal watercraft which adopts the deck structure according to the present invention. A steering mechanism 111 includes the steering shaft 92 mounted for rotation on a steering shaft hub 112. The steering handle member 19 (refer to FIG. 8) is attached to an end of the steering shaft 92. A steering plate 113 is attached to the other end of the steering shaft 92. One end of a driving cable 114 serving as a connection member is attached to the steering plate 113. The other end of the driving cable 114 is attached to the steering nozzle 18 (refer to FIG. 1) at the rear portion of the craft body 11. It is to be noted that reference numeral 106 denotes a swollen portion formed on the deck 20.

It can be considered that the maintenance opening arrangement structure 90 of the personal watercraft is configured such that, in the personal watercraft 10 wherein the front portion of the deck 20 of the personal watercraft is swollen upwardly to form the swollen portion 106 and the steering handle member 19 (refer to FIG. 8) is rotatably supported at a central upper portion of the swollen portion 106, and the steering handle member 19 and the steering nozzle 18 (refer to FIG. 1) are connected to each other by the driving cable (connection member) 114 disposed in the deck 20, the maintenance opening (sub opening) 98 is disposed in the left side wall (side wall) 97 of the swollen portion 106.

Where the maintenance opening (sub opening) 98 is disposed in the left side wall 97 of the swollen portion 106, maintenance of the driving cable 114 connecting to the steering handle member 19 (refer to FIG. 8) can be performed readily. As a result, improvement of the operability of the maintenance of the driving cable 114 can be anticipated.

The driving cable 114 includes an outer pipe 116 secured to the craft body side and an inner cable 117 movable with respect to the outer pipe 116. A supporting structure 120 for the driving cable is described with reference to the following figures.

Figure 11:
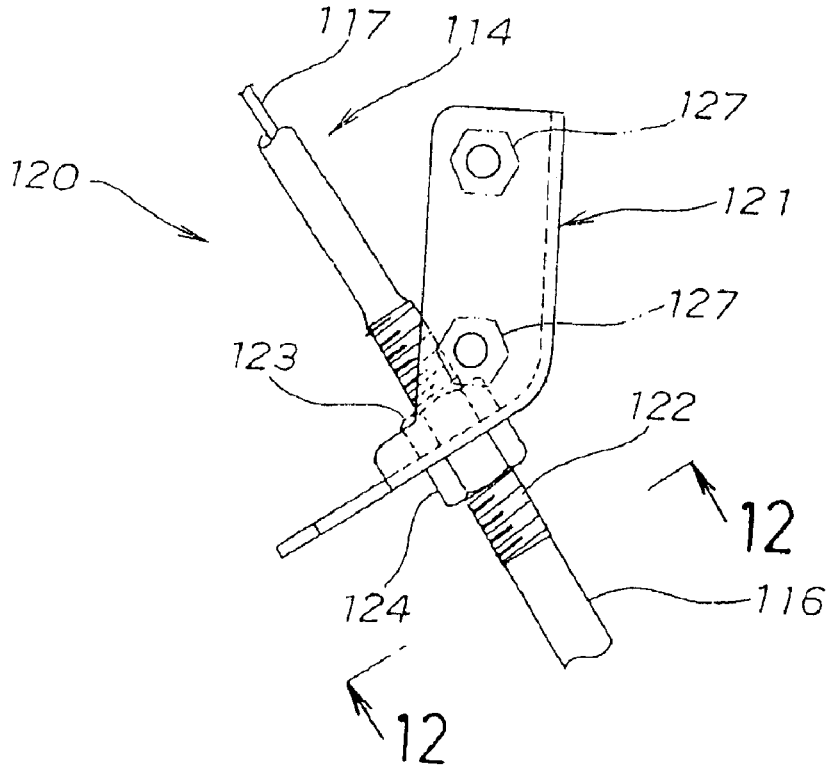
FIG. 11 is an enlarged view as viewed in the direction indicated by an arrow mark 11 in FIG. 10.
Figure 12:
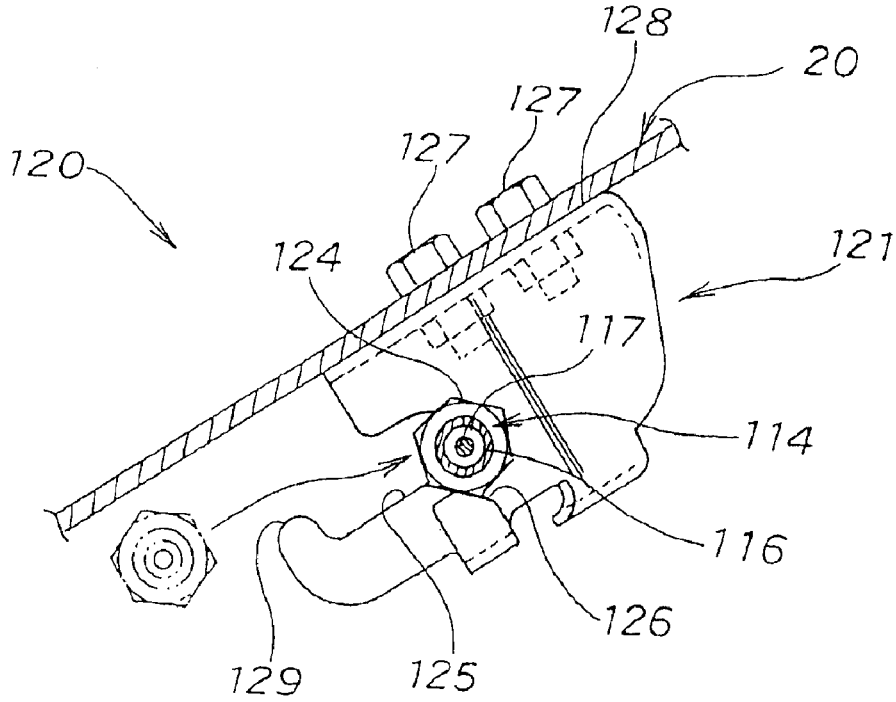
FIG. 12 is a sectional view taken along line 12–12 in FIG. 11.
Figure 13:
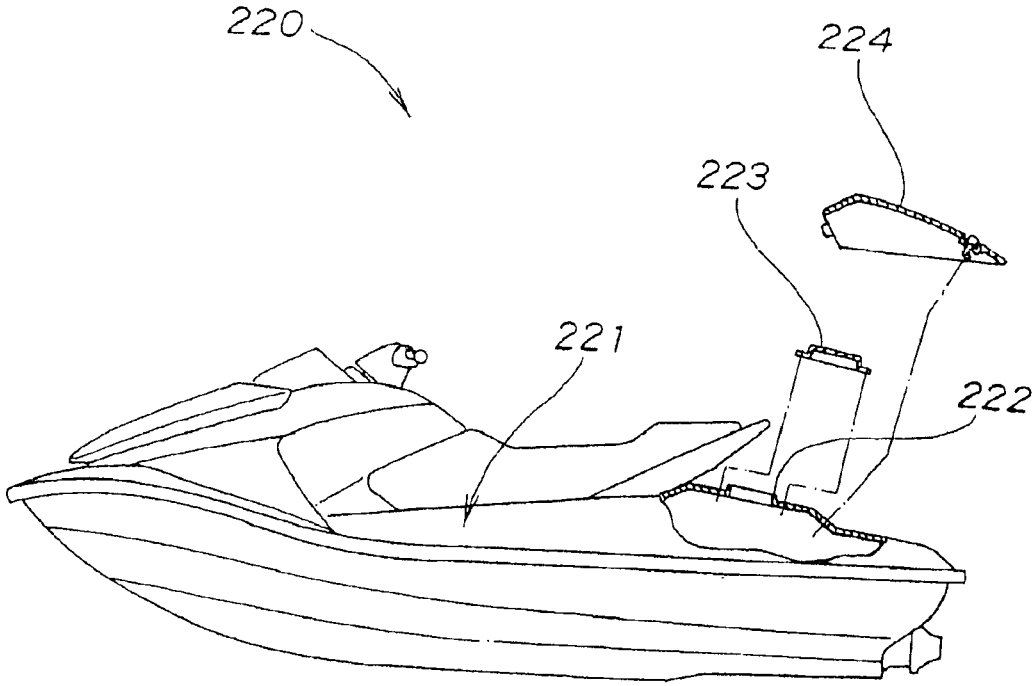
FIG. 13 is a schematic view of a comparative deck structure for a personal watercraft.

FIG. 11 is a view as viewed in the direction indicated by an arrow mark 11 of FIG. 10 and shows a plan of the supporting structure 120 for the driving cable. FIG. 12 is a sectional view taken along line 12—12 of FIG. 11 and shows a side elevation sectional view of the supporting structure 120 for the driving cable.

The supporting structure 120 for the driving cable has a structure whereby the outer pipe 116 of the driving cable 114 is supported on a bracket 121 attached to the reverse side of the deck 20 shown in FIG. 12. In particular, a male thread portion 122 is formed on the outer pipe 116, and first and second nuts 123 and 124 are screwed on the male thread portion 122. A U-shaped portion 125 is formed on the bracket 121 shown in FIG. 12, and the outer pipe 116 is secured by sandwiching the same in the U-shaped portion 125 with the first and second nuts of the outer pipe 116.

Further, a stopper 126 for stopping turning movement of the second nut 124 is formed on the bracket 121 as shown in FIG. 12 to prevent turning movement of the second nut 124 together with the first nut 123 shown in FIG. 11 when the first nut 123 is turned. Accordingly, since the first nut 123 is positioned rather near to the sub opening 98 (refer to FIG. 10), the driving cable 114 can be removed or attached by turning the first nut 123. As a result, improvement of the operability in attachment and removal of the driving cable 114 can be achieved.

In FIGS. 11 and 12, reference numerals 127, 127 denote bolts for securing the bracket 121 to the reverse face of the deck 20, reference numeral 128 denotes a deck side attaching face of the bracket 121, and 129 denotes a projection formed on the bracket 121 for preventing the outer pipe 116 from sliding off from the U-shaped portion 125 when the first nut 123 is loosened.

It is to be noted that, while, in the embodiment, the bridge plate 43 is removably attached to the rear portion opening 42 as shown in FIG. 2, the location of the bridge plate 43 is not limited to this, and it is only necessary to provide the bridge plate 43 on the boundary between the seat underlying opening 41 and the rear portion opening 42.

Further, while in the embodiment, the inner lid 45 is attached to the rear portion opening 42 at the rear portion of the craft body 11 (refer to FIG. 1) and the rear cover 48 is attached to the inner lid 45 as shown in FIG. 3, the configuration is not limited to this. In particular, the inner lid may be attached to any portion of the craft body, and the rear cover may be any cover which covers the inner lid.

Further, while in the embodiment, the attaching portion 104 is provided on the sub lid 103 and the exhaust duct 105 is attached to the attaching portion 104 as shown in FIG. 8, the exhaust duct may alternatively be an intake duct.

The present invention exhibits the following effects due to the configuration described above. According to one aspect of the invention, a projection is provided integrally on the locking member for the inner lid which allows attachment of the cover when the locking member is at a locked position, but is sandwiched between the deck and the cover to block attachment of the cover when the locking member is at an unlocked position, and a biasing member for biasing the locking member toward the unlocking position is provided between the locking member and the deck. Therefore, if the inner lid is not attached, then the cover cannot be fitted. As a result, the inner lid can be prevented from being not attached inadvertently.

Although the present invention has been described herein with respect to a limited number of presently preferred embodiments, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

What is claimed is:

1. An inner lid attaching structure for a personal watercraft having an inner lid removably attachable in covering relation to an opening provided in a deck of the personal watercraft and a cover removably attachable in covering relation to the inner lid, the attaching structure comprising:

a locking member which presses an edge of said inner lid placed on an edge of said opening against the edge of the opening when the locking member is in a locked position to assure air-tightness between said inner lid and the edge of the opening;

a projection provided integrally with said locking member which allows attachment of said cover when the locking member is at the locked position, but blocks attachment of said cover by being sandwiched between the deck and the cover when the locking member is at an unlocked position; and a biasing member which biases said locking member toward the unlocked position, and is provided between said locking member and the deck.

2. An inner lid attaching structure according to claim 1, wherein said attaching structure is fixed to the deck of the personal water craft.

3. An inner lid attaching structure according to claim 1, wherein said locking member is pivotably fixed to the deck of the personal water craft, and is rotatable between said locked and unlocked positions.

4. An inner lid attaching structure according to claim 3, wherein said projection is provided at portion of said kicking member furthest from a pivot axis of the locking member.

5. An inner lid attaching structure according to claim 1, further including a mechanism which normally maintains said locking member in the locked position when said inner lid is pressed by said locking member.

6. An inner lid attaching structure according to claim 5, wherein said mechanism includes a recess formed on one of said locking member and said inner lid, and a projection formed on the other of said locking member and said inner lid which matingly engages said recess.

7. An inner lid attaching structure for a personal watercraft having an inner lid removably attachable to a deck of the watercraft in covering relation to an opening provided in the dock and a cover removably attachable to the deck in covering relation to the inner lid, the attaching structure comprising:

a locking member which secures said inner lid in an air-tight manner over said opening; and a projection provided integrally with said locking member which prevents attachment of said cover when said inner lid is not secured over said opening.

8. An inner lid attaching structure according to claim 7, wherein said projection prevents attachment of said cover by being sandwiched between the deck and the cover when said inner lid is not secured over said opening.

9. An inner lid attaching structure according to claim 7, wherein said attaching structure is fixed to the deck of the personal water craft.

10. An inner lid attaching structure according to claim 7, further including a mechanism which normally maintains said locking member in a locked position thereof when said inner lid is secured over said opening by said locking member.

11. An inner lid attaching structure for a personal watercraft having an inner lid removably attachable to a deck of to watercraft in covering relation to an opening provided in the deck and a cover removably attachable to the deck in covering relation to the inner lid, the attaching structure comprising:

a locking member which scans said inner lid in an air-tight manner over said opening; and a projection provided integrally with said locking member which prevents attachment of said cover when said inner lid is not secured over said opening, and wherein said locking member is selectively movable between locked and unlocked positions;

said attaching structure includes a biasing member which biases said locking member toward the unlocked position; and said projection blocks attachment of said cover when said locking member is in said unlocked position.

12. An inner lid attaching structure for a personal watercraft having an inner lid removably attachable to a deck of the watercraft in covering relation to a opening provided in the deck and a cover removably attachable to the deck in covering relation to the inner lid, the attaching structure comprising:

a locking member which secures said inner lid in an air-tight manner over said opening; and a projection provided integrally with said locking member which prevents attachment of said cover when said inner lid is not secured over said opening, wherein said locking member is selectively movable between locked and unlocked positions;

said attaching structure includes a biasing member which biases said locking member toward the unlocked position;

said projection blocks attachment of said cover when said looking member is in said unlocked position; and wherein said locking member is pivotally fixed to the deck of the personal water craft and is rotatable between said locked and unlocked positions.

13. An inner lid attaching structure for a personal watercraft having an inner lid removably attachable to a deck of the watercraft in covering relation to an opening provided in the deck and a cover removably attachable to the deck in covering relation to the inner lid, the attaching structure comprising:

a locking member which secures said inner lid in an air-tight manner over said opening; and a projection provided integrally with said locking member which prevents attachment of said cover when said inner lid is not secured over said opening, wherein said locking member is selectively movable between locked and unlocked positions;

said attaching structure includes a biasing member which biases said locking member toward the unlocked position;

said projection blocks attachment of said cover when said locking member is in said unlocked position; and wherein said locking member is pivotally fixed to the deck of the personal water craft, and is rotatable between said locked and unlocked positions, and wherein said projection is provided at portion of said locking member furthest from a pivot axis of the locking member.

14. An inner lid attaching structure for a personal watercraft having an inner lid removably attachable to a deck of the watercraft in covering relation to an opening provided in the deck and a cover removably attachable to the deck in covering relation to the inner lid, the attaching structure comprising:

a locking member which secures said inner lid in an air-tight manner over said opening;

a projection provided integrally with said locking member which prevents attachment of said cover when said inner lid is not secured over said opening, and a mechanism which normally maintains said locking member in a locked position thereof when said inner lid is secured over said opening by said locking member, wherein said mechanism includes a recess formed on one of said locking member and said inner lid, and a projection formed on the other of said looking member and said inner lid which matingly engages said recess.

15. An inner lid attaching structure for a personal watercraft comprising an inner lid removably attachable to a deck of the watercraft in covering relation to an opening provided in the deck, and a cover removably attachable to the deck in covering relation to the inner lid such that it is separable from both the deck and the inner lid, the attaching structure comprising:

a locking member which secures said inner lid in an air-tight manner over said opening; and a projection provided integrally with said locking member which prevents attachment of said cover when said inner lid is not secured over said opening.

* * * * *